United States Patent [19]

Davis et al.

[11] 3,951,348

[45] Apr. 20, 1976

[54] CRUSHER BOWL CLAMPING SYSTEM

[75] Inventors: D. Carter Davis, Menomonee Falls; Ulhas S. Sawant, Sussex; Francis Scaffidi, West Allis, all of Wis.

[73] Assignee: Rexnord Inc., Milwaukee, Wis.

[22] Filed: Sept. 18, 1974

[21] Appl. No.: 507,219

Related U.S. Application Data

[63] Continuation-in-part of Ser. No. 363,655, May 24, 1973, abandoned, which is a continuation-in-part of Ser. No. 241,313, April 5, 1972, Pat. No. 3,797,760.

[52] U.S. Cl. ..... 241/290; 241/207

[51] Int. Cl.[2] ..... B02C 4/28

[58] Field of Search ..... 241/207–216, 286, 290; 269/32

[56] References Cited

UNITED STATES PATENTS

| | | | |
|---|---|---|---|
| 2,555,064 | 5/1951 | Stevens et al. | 241/286 |
| 3,009,660 | 11/1961 | Symons et al. | 241/290 |
| 3,088,684 | 5/1963 | Szaj | 241/290 |
| 3,272,446 | 9/1966 | Hesse | 241/290 X |
| 3,325,108 | 6/1967 | Balmer et al. | 241/290 |
| 3,328,888 | 7/1967 | Gieschen et al. | 241/213 X |
| 3,397,846 | 8/1968 | Archer | 241/286 |
| 3,420,457 | 1/1969 | Peters et al. | 241/286 X |
| 3,688,995 | 9/1972 | Kyeneman et al. | 241/207 |
| 3,752,464 | 8/1973 | Csatlos | 269/32 |

*Primary Examiner*—Granville Y. Custer, Jr.
*Assistant Examiner*—Howard N. Goldberg
*Attorney, Agent, or Firm*—Kinzer, Plyer, Dorn & McEachran

[57] ABSTRACT

This is concerned with a so-called gyratory crusher bowl clamping system in which a screw-threaded bowl is rotated for adjustment and a so-called rocker arm pressure-off clamping system is provided which avoids dirt, dust and sealing problems. The crusher includes a frame which is greatly simplified, but has increased strength and rigidity as well as a support for the crushing head that greatly simplifies manufacturing and machining problems.

7 Claims, 6 Drawing Figures fig. 4.
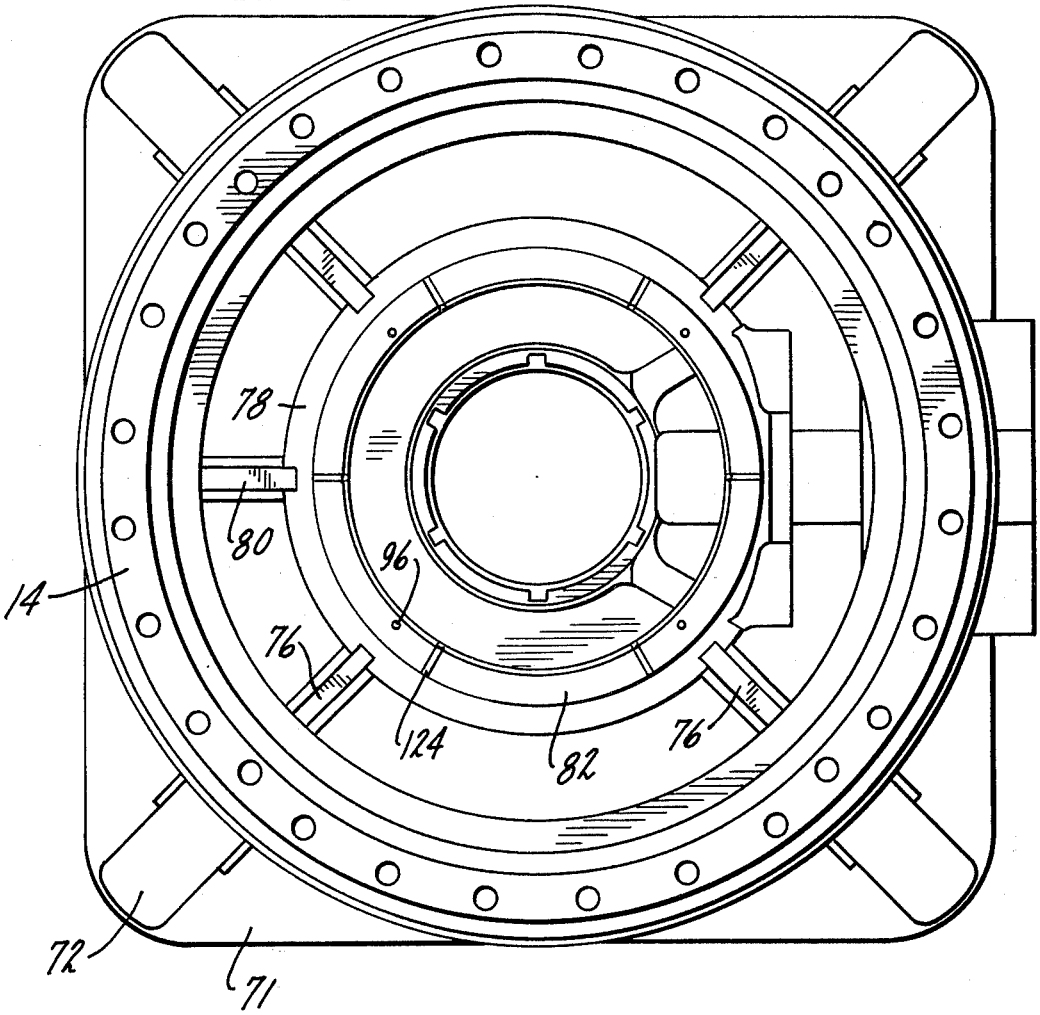
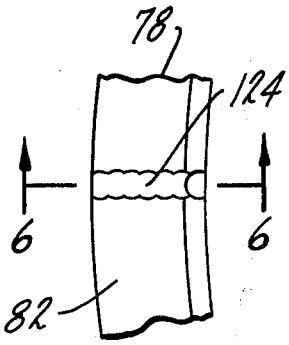
fig. 5.
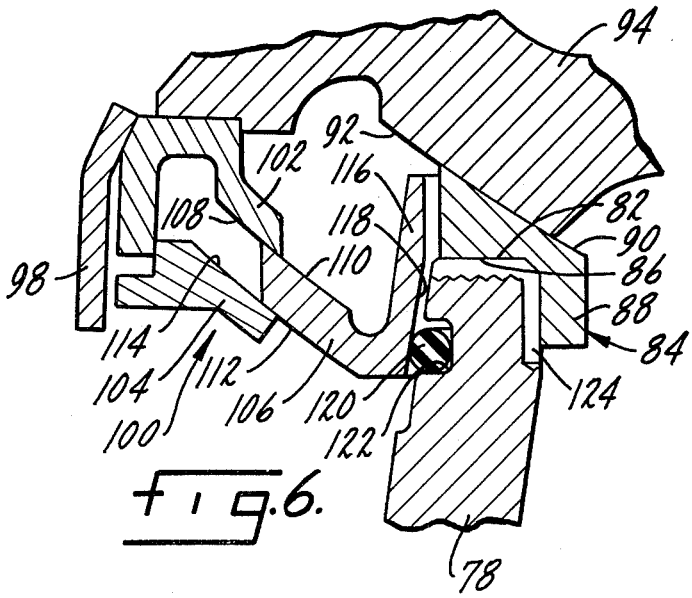
fig. 6.

CRUSHER BOWL CLAMPING SYSTEM

This is a continuation-in-part of Ser. No. 363,655, filed May 24, 1973, now abandoned, which was a continuation-in-part of Ser. No. 241,313, filed Apr. 5, 1972, now U.S. Pat. No. 3,797,760, issued Mar. 19, 1974.

SUMMARY OF THE INVENTION

This invention is concerned with a gyratory crusher and is a bowl clamping system of the so-called pressure-off type.

A primary object of the invention is a bowl clamping system which may be released quickly but, when applied, clamps the bowl so that it will not rotate.

Another object is a quick release system for a bowl clamping system that permits quick adjustment of the bowl.

Another object is a bowl clamping system for a crusher where the bowl is screw-threaded in relation to a tilting ring which eliminates any dust and dirt problems in the bowl threads.

Another object is a bowl clamping system for a crusher that avoids any dust and dirt problems between the frame and/or the adjustment ring and bowl.

Another object is a frame for a gyratory crusher which is simple to manufacture but has greatly increased strength and strain resistance.

Another object is a frame of the above type which is specifically arranged to carry the extra stresses imposed thereon by a hydraulic crusher clearing system.

Another object is a simplified head support for such a crusher.

Another object is a head support for a gyratory head in such a crusher which reduces the expense of manufacture.

Another object is a single line spring arrangement to minimize or eliminate spring clusters and to secure a compact crusher frame and adjustment ring configuration.

Other objects will appear from time to time in the ensuing specification and drawings.

BRIEF DESCRIPTION OF THE DRAWINGS

FIG. 4 is a top view of the frame for the crusher with the bowl and head structures removed and on a reduced scale;

FIG. 5 is an enlarged view of a portion of FIG. 4 showing the upper surface of the center hub of the frame; and FIG. 6 is a section along line 6—6 of FIG. 5.

DESCRIPTION OF THE PREFERRED EMBODIMENT

Figure 1:
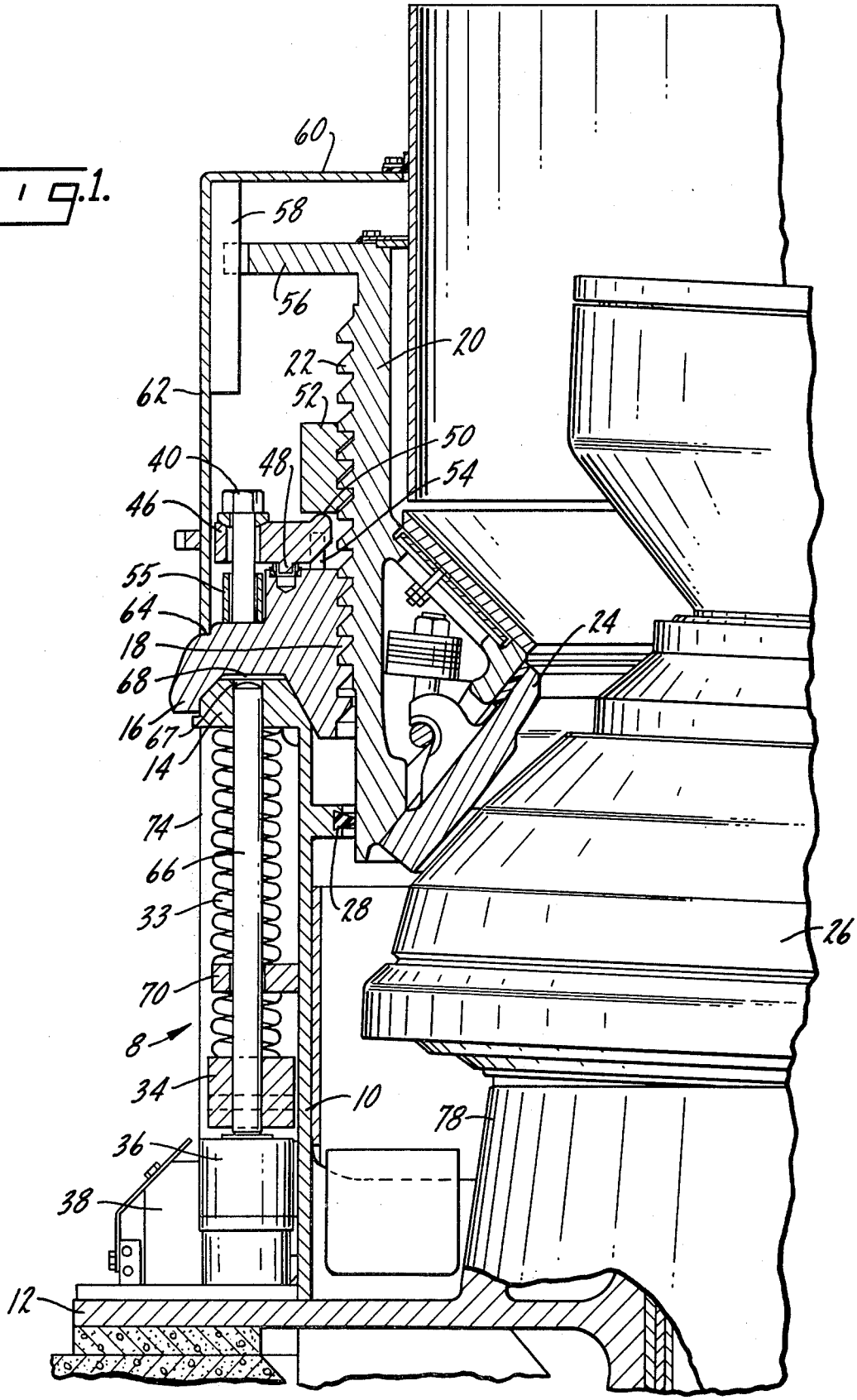
FIG. 1 is a vertical radial section of the main frame and bowl of a cone crusher.

The crusher shown has a generally circumferential main frame 8 with an outer circumferential wall 10 which may have a base flange 12 and an outstanding circumferential upper flange 14 adjacent its upper end. Conforming to and centered on and normally fixed in relation to the upper flange is a bowl support or tilting ring 16. The inner surface 18 of the tilting ring is screwthreaded and accepts a bowl 20, the cylindrical outer surface of which is also screw-threaded, as at 22, in the usual manner. The bowl itself may carry the usual manganese steel wearing part 24, commonly referred to as a bowl liner, with a gyratable head 26 being mounted in the main frame and opposing the bowl liner, all of which is conventional. The lower opening of the threads 18 and 22 may be protected by a suitable seal 28.

The tilting ring 16 is held down releasably against the main frame flange 14 by a plurality of springs arranged in clusters, as indicated at 30. The upper ends of the springs engage the bottom of the main frame flange, while the lower ends are retained by and in engagement with a movable abutment 32 so as to apply a downthrust to the tilting ring and releasably hold it down against the main frame, in a conventional manner.

Figure 3:
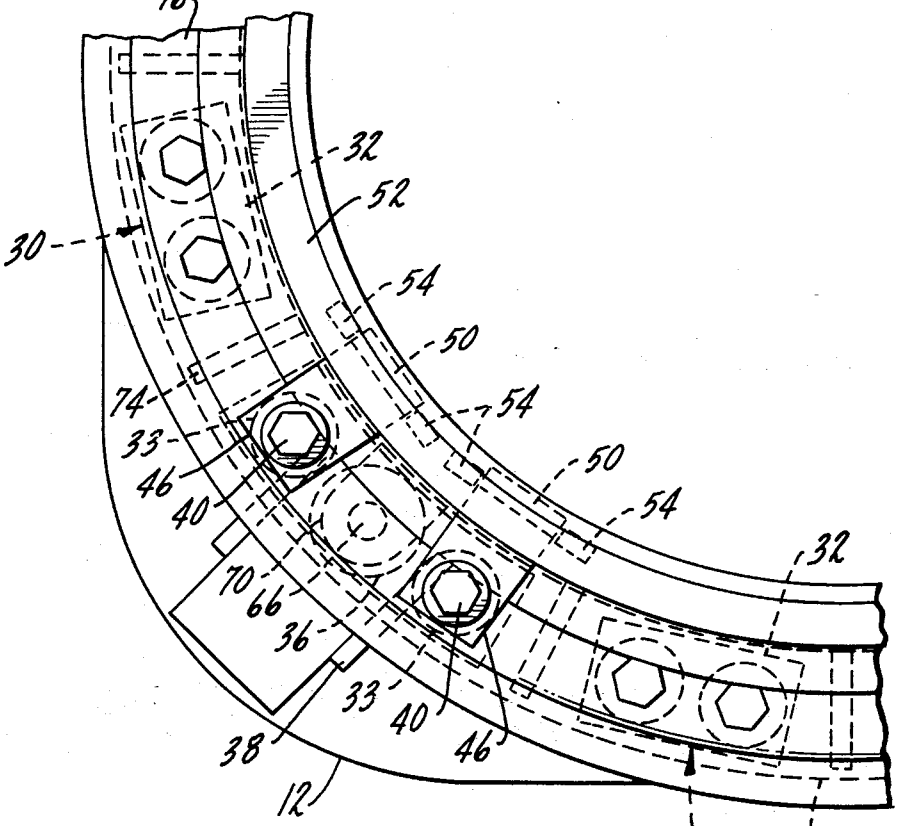
FIG. 3 is a top view of a part of the main frame with the top cap removed.
Figure 2:
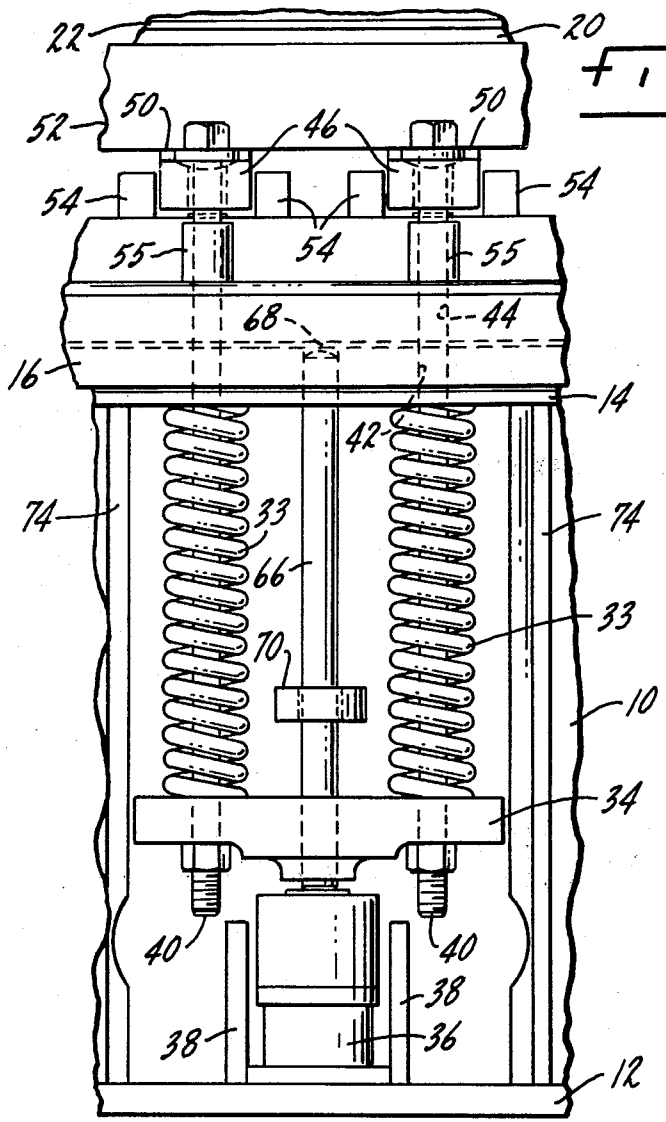
FIG. 2 is a side view of a part of FIG. 1 with the top cap removed.

As shown in FIGS. 1 and 2, certain of the springs, designated 33, engage a lower spring segment or crosshead 34 at the bottom so that they are paired with the bottom of the crosshead being opposed by a jack 36 which may be suitably mounted on the main frame lower flange 12, as by welding or otherwise, and is held between paired strengthening webs 38. Paired special purpose springs 33 have spring bolts 40 which extend upwardly through openings 42 in the main frame flange and 44 in the tilting ring and connect to the outer end of rocker arms 46, one such rocker arm for each special purpose bolt, as shown in FIG. 3. The spring bolts 40 are so designed as to minimize stress in the root of the threads to avoid fatigue and breakage. Each of the rocker arms pivot at 48 in a suitable swivel thrust bearing or ball joint with the inner nose 50 of the rocker arms being disposed under a clamp ring 52 which is screw-threaded to the exterior of the bowl. Blocks 54 are welded or otherwise suitably positioned on the upper surface of the tilting ring 16 on each side of the rocker arms to keep them properly disposed. Spring bolts 40 may have spacers 55 around them and under the other end of the rocker arms so that when the bowl is removed for a manganese change or otherwise, spring pressure will be taken by the spacers.

The upper part of the bowl carries a plurality of outwardly disposed ears 56 which are slotted to accept a key 58 on the inside of a top cap 60 which has a circumferential outer portion or shield 62 extending down so that the lower portion thereof rests on and is in sealing engagement with the tilting ring, as at 64.

Each of the jacks 40 is aligned with a push rod 66 which extends up through the crosshead 34 and into a suitable opening 67 in the main frame flange 14, terminating a short distance, as at 68, from the bottom of the tilting ring. One or more suitable guides 70 may be welded or otherwise suitably secured to the exterior of the main frame to keep the pushrods properly aligned.

As shown in FIG. 4, the lower portion or base 12 of the frame may be considered to be generally square with corners 71 where the jacks are located. Each of the jacks is positioned on a pad or plate 72 with the jacks themselves being beneath the top flange or overhang 16 on top of the reinforcing pad on the bottom flange. The paired springs 30 are disposed on each side of the special purpose springs 33 which in turn are on each side of or straddle the jacks at the corners. Reinforcing webs 74 are disposed at intervals about the outer wall 10 and they are connected to the lower surface of the upper flange 14, the upper surface of the lower flange or base 12 and the outer surface of the circumferential wall 10. These webs 74, as shown in FIG. 3, are positioned between the various spring groups and at intervals around the crusher so that a solid stress-resistant closed C-clamp effect is provided all the way around which will easily accommodate or accept the stresses imposed on the frame by the crushing and jacking loads when a plugged crusher is being cleared.

The frame also has internal webs 76 which connect the outer wall 10 to a center hub 78 which is the support and housing for the gyrated head. As shown in FIG. 4, these internal webs 76 are generally radially disposed and are grouped with the jacks at the corners to tie the center hub directly to the portion of the main frame directly affected by the jacking loads. Since there are four jacks, one on each corner, four internal webs 76 are used, one aligned with each of the jacks at the corners. Additional webs may be used at locations not aligned with the jacks, as indicated at 80 in FIG. 4, but this may not be necessary or important as compared to the webs 76 which are aligned with each of the corners.

The center hub 78 rises to an upper, generally flat, horizontal surface 82 which accepts and supports a so-called head ball liner 84 which, as shown in FIG. 6, has a generally horizontal flat surface 86 constructed and arranged to rest on the upper surface 82 of the hub and an inner depending, circumferential pilot or flange 88 which engages the inside of the hub and centers the head ball liner. The liner itself is made of brass or bronze or any suitable bearing material and has an upper surface 90 which is generally spherical, machined and highly polished, and convex so as to accept a corresponding spherical convex ball surface 92 on the bottom or lower portion of the crushing head 94. The head ball liner 84 may be held in position by pins or dowels 96 which are placed at intervals around the upper surface of the center hub. The head may have a depending skirt 98 with a seal underneath, indicated generally at 100. The seal may include upper and lower retainers 102 and 104, connected to the head, which engage a ring 106 between them. The upper retainer 102 has a sperical lower surface 108 which engages a spherical upper surface 110 on a sealing flange on the ring. The lower surface 112 of the sealing flange is also spherical and engages a spherical upper surface 114 on the lower retainer. The ring has an upstanding body portion 116 which has a somewhat inwardly and upwardly tapered inner surface 118 which bears against a large seal or "O" ring 120 which is positioned in a groove 122 in the upper end of the main frame hub. The seal ring itself may be made of rubber or neoprene or polyurethane or a rubber substitute with the outer surface of the seal ring engaging the tapered inner surface 118 in sealing contact but flexibly holding the ring in place as the head gyrates. A drain passage 124 may be provided for lubricant flow.

The use, operation of function of the invention are as follows:

So-called "pressure-off" bowl clamping systems for cone crushers which have a rotatable bowl connected or mounted in the crusher by screw threads are quite popular because while the machine is operating under load, the hydraulic system is not under pressure. One conventional type of such a system is shown in U.S. Pat. No. 3,009,660, issued Nov. 21, 1961, and U.S. Pat. No. Re. 27,482, issued Sept. 19, 1972.

One of the difficulties of a bowl-clamping system in the structure as shown in those two prior patents is that they necessitate an opening through the top cap at various intervals to accept the rocker arms. And this provides access for dirt and dust which, first, settles on the bowl threads and around the seals, second, covers the rocker arms and, third, cakes underneath the rocker arm, all of which will make the unit difficult, if not impossible, to adjust when the time comes, requiring frequent cleaning, careful maintenance and accurate inspection.

The present invention has the advantages that the rocker arms and clamp ring are totally enclosed, shrouded and protected by the top cap or baffle. This is a substantial safety advantage. The bottom edge of the baffle does not require any elaborate sealing arrangement whether it is in direct contact with the upper surface of the tilting ring, as shown herein, or overlaps the outside of a upstanding skirt, such as shown in U.S. Pat. No. 3,397,846, issued Aug. 20, 1968.

The present form of pressure-off clamping system has the additional advantage that it does not require special parts and components, but rather can be made from standard units. The hydraulic jacks may be purchased on the open market and the rocker arms, pushrods, springs, etc. are all standard items and/or easily manufacture.

The dimensioning is such that the jacks may perform a number of different functions. For example, by an initial partial excursion, they may engage the lower spring segments 34 and cause the bowl clamping springs 33 to be sufficiently compressed such that the reaction thereof on the bowl will be relieved to an extent such that the bowl may be rotated for adjustment, by any suitable means, not shown, but will still be held firmly up in the tilting ring threads so that the crusher may be run under load during adjustment. The jacks may have a second degree or extent of excursion to compress the springs 33 more so that the bowl will be completely released and may be rapidly rotated, for example, when the manganese is worn out and must be changed. The jacks may have a further or third extent of excursion which will be such as to cause the pushrods 66 to engage the bottom of the adjustment ring and raise it, thereby compressing all of the springs of the spring release, so that the cavity may be cleared, for example if it is plugged with tramp iron, large pieces of wood or jammed due to a power failure.

In certain situations rotation of the bowl may be desirable but not necessary for adjustment. A clamping system of the type shown would have the advantage that the bowl could be firmly clamped and could be released so it could be rotated, whether the rotation actually adjusts the machine or not. Also, the force-applying means has been indicated as springs, so-called "special purpose springs," but it should be understood that air cylinders, hydraulic cylinders, or otherwise could be used in place of the special purpose springs if the so-called "pressure-on" system is desired. In that event, for example, hydraulic cylinders could be substituted for the special purpose springs to pull down on special bolts 40 to apply a clamping thrust to th bowl through the rocker arms. In addition, clamping and release of the bowl may be effected in many different ways other than by a threaded external clamp ring meshing with the exterior of the threaded bowl. For example, the clamp ring might be a so-called internal clamp ring with a threaded exterior that meshes with the threaded interior of the adjustment ring. Also, the bowl might be clamped by wedges, which is a well known arrangement, with the rocker arms thrusting up on the wedges to clamp the bowl in place, with the wedges being drawn down by a suitable power means, for example, such as a cylinder, to release the bowl so that it can be raised and lowered for adjustment without rotation.

But in all such arrangements, the point is that the thrust-transmitting means includes the rocker arm concept which is totally enclosed by a top cap or shield arrangement that prevents dirt and dust from getting in between the bowl and frame, whether those parts merely slip, rotate, or what-have-you, and whether the movement of the bowl is for adjustment to open and close the crushing cavity or to distribute wear uniformly around the manganese wearing parts.

When the bowl and tilting ring are jacked up so that a plugged crusher may be cleared, the entire thrust or force of the spring release including the special purpose springs must be overcome. Thus the jacks, as a group, must provide a tremendous thrust since they have overcome and compress the springs in addition to lifting the dead weight of the bowl and its associated structure. All of this force or thrust will be taken between the top and bottom flanges on the outside of the main frame which in the past has required that the main frame itself be a large rugged expensive unit. It's been a continuous quest to reduce the size and expense of the main frame for crushers of this type without sacrificing strength.

In the present arrangement, the upper and lower flanges of the main frame are tied together at appropriate intervals by stiffening webs or ties which are connected to the lower surface of the upper flange, the upper surface of the lower flange, and also along the outer surface of the peripheral wall which gives 360° of a closed C-clamp effect all the way around the frame — a toroidal C-clamp. This greatly strengthens the frame and allows its various parts and components to be smaller and less expensive than otherwise. At the same time, no strength is sacrificed and, in fact, the strength of the overall frame is sacrificed and, in fact, the strength of the overall frame is greatly inreased.

In addition, strengthening webs, either cast integrally in or welded in a fabricated setup, are disposed in radial alignment between the inside of the circumferential wall and the center hub and aligned with the jacks at the corners so as to give a composite unitary structure from the center hub out. This direct tie between the center hub and the jacking corners has the distinct advantage of equalizing the stresses during jacking throughout the entire frame structure.

The head ball liner, as shown in FIG. 6, is constructed and arranged so that only its surface has to be machined into a spherical socket. Its lower surface may be as-cast or fabricated and does not require any special machinery for grinding. The head ball liner may be easily mounted on the plane upper surface at the top of the center hub which in turn does not have to be machined or ground into a spherical socket. While the amount of metal, be it brass or otherwise, in the head ball liner itself may be increased somewhat, this is more than offset by the saving in machining, which nowadays is tremendously expensive. The particular method shown and described herein for mounting the head ball liner on the upper end of the hub makes it easy to remove and replace a worn liner and no remachining or grinding of the upper end of the center hub is necessary when a new head ball liner is installed. Normally another member is necessary to provide for the crusher from the top, but the present arrangement provides for servicing other components beneath the head ball liner.

While a preferred form and several variations of the invention have been disclosed, it should be understood that suitable additional modifications, changes, substitutions and alterations may be made without departing from the invention's fundamental theme.

The embodiments of the invention in which an exclusive property or privilege is claimed are defined as follows:

1. In a gyratory crusher, a circumferential main frame with an outwardly extending flange adjacent its upper end, a bowl-supporting ring tiltably mounted on the flange and movable upwardly therefrom for tramp iron clearance, a bowl mounted in screw-threaded relation in the bowl-supporting ring so that it may be adjusted by rotation, an external clamp ring in screwthreaded relation with the bowl positioned above and fixed in relation to the bowl-supporting ring so that it will not rotate with the bowl, a plurality of rocker arms disposed about and pivoted on the bowl-supporting ring engaging the underside of the clamping ring, spring means biasing the outer end of the rocker arms down so as to bias the clamping ring and bowl up, and a top cap covering the rocker arms, the clamp ring and the exterior of the bowl in sealing relation with the bowl-supporting ring throughout its 360° of peripheral extent so as to prevent the entry of dust and dirt into and around the rocker arms, clamp ring and bowl, the top cap being constructed and arranged to peripherally surround the rocker arms with the lower peripheral edge of the top cap resting on the exterior of the bowl-supporting ring so that the weight thereof is taken by the bowl-supporting ring, the outer ends of the rocker arms being relatively adjacent but spaced inwardly somewhat from the inside of the top cap so that operation of the rocker arms to clamp and unclamp the bowl does not raise and lower the top cap.

2. The structure of claim 1 further characterized by and including power means for compressing the spring means so as to at least partially relieve the clamping upthrust on the bowl.

3. The structure of claim 2 further characterized in that the power means includes a plurality of jacks positioned about the frame of the crusher and aligned with pushrods resting on the jacks which extend upwardly through the outwardly extending flange at the upper end of the frame and oppose the bowl-supporting ring so that initial operation of the jacks will raise the pushrods which in turn engage the bowl-supporting ring to lift it, thereby compressing and overcoming the spring means, and a plurality of guides connected to the exterior of the main frame intermediate the ends of the pushrods and allowing movement of the pushrods but effective to maintain the general vertical disposition of the pushrods in opposition to any outward reactive thrust due to misalignment between the jacks and spring means.

4. The structure of claim 1 further characterized by and including a swivel thrust bearing between each of the rocker arms and the bowl supporting ring.

5. The structure of claim 1 further characterized in that the rocker arms are arranged in pairs, a pair of tie rods connected to the outer ends of the pair of rocker arms and extending downwardly through the bowl-supporting ring and main frame flange, a crosshead connected between the lower ends of the paired tie rods, a jack positioned on the frame between the paired tie rods and disposed under the crosshead, and a pushrod between the paired tie rods extending upwardly from the crosshead into and through the main frame flange.

6. The structure of claim 5 further characterized by and including a spring around each of the paired tie rods and under compression between the main frame flange and the crosshead.

7. The structure of claim 1 further characterized by and including abutments on the upper surface of the bowl-supporting ring on each side of the inner end of the rocker arms to keep them generally radially disposed.

* * * * *